US006302787B1

(12) United States Patent
Graft, Jr.

(10) Patent No.: US 6,302,787 B1
(45) Date of Patent: Oct. 16, 2001

(54) ROOF VENT

(76) Inventor: Michael J. Graft, Jr., 914 S. Northwest Hwy., Barrington, IL (US) 60010

( * ) Notice: Subject to any disclaimer, the term of this patent is extended or adjusted under 35 U.S.C. 154(b) by 0 days.

(21) Appl. No.: 09/515,757

(22) Filed: Feb. 29, 2000

(51) Int. Cl.[7] ..... F24F 7/02
(52) U.S. Cl. ..... 454/366; 454/358
(58) Field of Search ..... 454/366, 242, 454/243, 250, 368, 35

(56) References Cited

U.S. PATENT DOCUMENTS

| | | | | |
|---|---|---|---|---|
| 925,251 | * | 6/1909 | Warden | 454/366 |
| 3,579,930 | * | 5/1971 | Murphy | 52/24 |
| 3,598,688 | | 8/1971 | Bellamy . | |
| 3,756,895 | | 9/1973 | Ballamy . | |
| 4,397,225 | * | 8/1983 | Patton | 454/366 |
| 4,489,531 | | 12/1984 | Nelson . | |
| 4,490,952 | | 1/1985 | Winston . | |
| 4,942,699 | | 7/1990 | Spinelli . | |
| 5,025,712 | * | 6/1991 | Perry | 454/366 |
| 5,167,579 | | 12/1992 | Rotter . | |
| 5,207,033 | | 5/1993 | Sells . | |
| 5,352,154 | | 10/1994 | Rotter et al. . | |
| 5,394,663 | * | 3/1995 | Jackson | 52/199 |
| 5,425,672 | | 6/1995 | Rotter . | |
| 5,435,780 | * | 7/1995 | Ayles | 454/199 |
| 5,535,559 | * | 7/1996 | Nielsen et al. | 52/199 |
| 5,561,952 | * | 10/1996 | Damron | 454/367 |
| 5,564,953 | | 10/1996 | Rotter . | |
| 5,630,752 | * | 5/1997 | Gubash | 454/366 |
| 5,676,597 | | 10/1997 | Bettoli et al. . | |
| 5,704,834 | | 1/1998 | Sells . | |
| 5,765,329 | * | 6/1998 | Huang | 52/302.3 |

* cited by examiner

*Primary Examiner*—Harold Joyce
*Assistant Examiner*—Derek S. Boles
(74) *Attorney, Agent, or Firm*—Keith A. Vogt; Niro, Scavone, Haller & Niro

(57) ABSTRACT

A roof vent for obstructing snow from entry into a vented space of a structure or dwelling. The vent has a cover, support, and base. The base is adapted to form a passageway which connects the vented space to the environment. A barrier is also provided which is located within the passageway. The barrier permits air movement but causes snow to accumulate thereon which prevents accumulation in the vented space.

6 Claims, 1 Drawing Sheet

ROOF VENT

BACKGROUND OF INVENTION

The device relates to a roof vent that is adapted to prevent damaging amounts of snow from accumulating in the interior of a home or other facility.

SUMMARY OF THE INVENTION

Roof vents are commonly used in the home construction industry to vent the interior portions of a home or some other type of building while preventing environmental elements such as rain and snow from gaining access into the interior. However, in some climates, the roof vent is exposed to a combination of snow and wind. It has been found that this combination will actually cause snow to blow up into and through the vent and accumulate inside the vented area due to the design of the vent. When the snow then melts in the home, expensive water damage occurs. Thus, there is a need for a roof venting system that is economical to manufacture and which will help reduce damaging amounts of wind blown snow from gaining access to the interior space of a building.

It has been discovered that such a roof vent may be constructed by disposing within a roof vent a barrier layer of water resistant, porous fibrous material. This layer permits air to pass easily through it but prevents large amounts of snow from passing through. Thus, the barrier layer will only allow a small accumulation of snow in the portion of the vent directly above the barrier while preventing damaging amounts of snow from accumulating in the interior where water damage may result.

DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENT

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
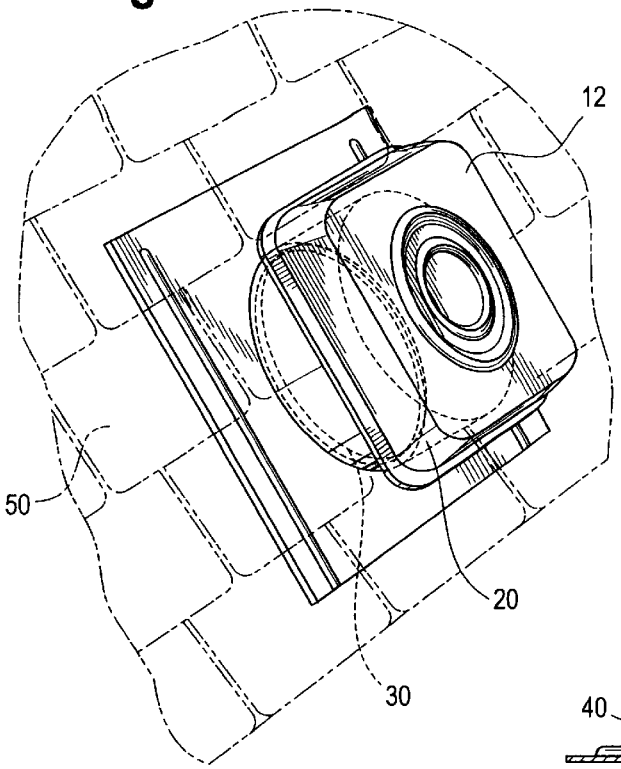
FIG. 1 is a perspective view of one embodiment of the present invention.

As shown in FIG. 1, the roof vent 10 of the present invention includes a cover 12, which is sized to be larger than cylindrical support 14, and a base 16 which is adapted to be affixed to roof 50 in ways known to those of skill in the art.

The basic structure and design of the vent is known to those of skill in the art. For example, person of skill will know how to connect cover 10, support 14 and base 16 together form passage 20 which connects the vented space or building interior to the outside environment.

Figure 3:
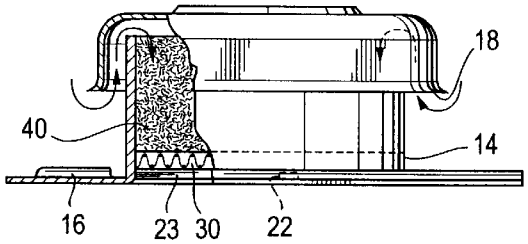
FIG. 3 is a side view of the embodiment shown in FIG. 1 with portions removed to show various aspects of the invention.
Figure 2:
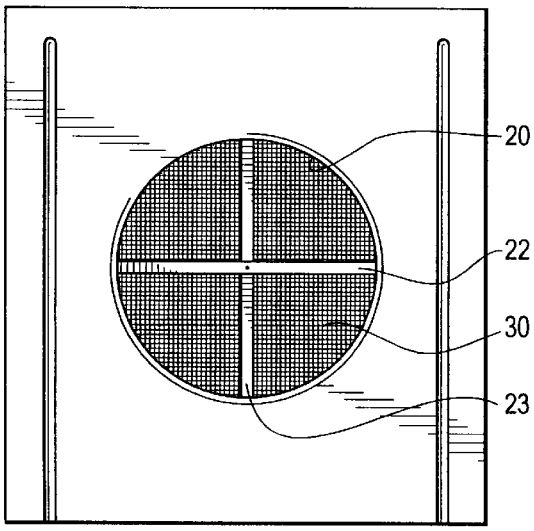
FIG. 2 is a bottom view of the embodiment shown in FIG. 1.
Figure 4:
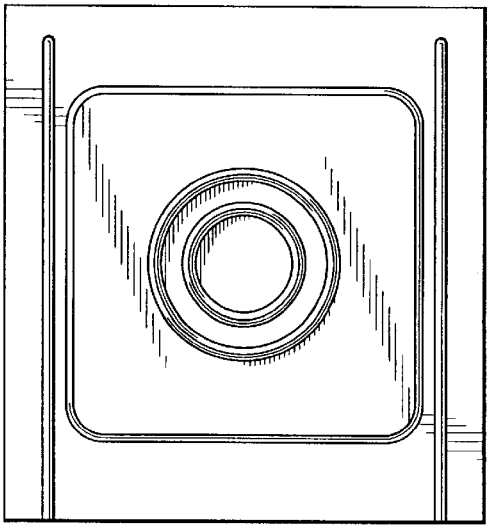
FIG. 4 is a top view of the embodiment shown in FIG. 1.

Disposed within passage 20 is a barrier 30 as shown in FIGS. 1–3. The barrier may be supported by cross braces 22 and 23. Barrier may be made of a water resistant material that forms a web like structure that is configured to catch or cause snow accumulation while still permitting efficient air movement through the barrier when snow is not present. It has been found that RHR25301 made by Purolator is a suitable barrier material.

In use, the roof vent 10 stops the accumulation of damaging amounts of snow inside a building. During snow falls, to the extent snow 40 is blown into the vent, it will mainly accumulate on barrier 30. While some snow may penetrate barrier 30 in certain situations, and melt inside the building, the amount of water created will generally be insufficient to cause damage.

Moreover, in extreme situations, passage 20 may actually fill with snow and clog vent 10. Once this occurs, no further snow accumulation will occur. Also, even though this snow will also melt and create water inside the building, it has been found that the insignificant amount created will not generally cause damage.

Thus, it has been found that although barrier 30 does not create a completely impervious obstruction to snow, it does limit the amount of snow to a level that will generally cause little or no water damage upon melting.

While the invention has been described with reference to the preferred embodiments thereof, it will be appreciated that numerous variations, modifications, and alternate embodiments are possible, and accordingly, all such variations, modifications, and alternate embodiments are to be regarded as being within the spirit and scope of the invention.

What is claimed is:

1. A roof vent for obstructing the entry of snow comprising:

a cover, support, and base mountable to a support surface;

said support holds said cover above said base so that said cover encloses said support to form at least one opening between said cover and said support;

said support further includes at least one sidewall which forms a passageway which connects a vented space to the environment; and a barrier located in said passageway and remotely located from said opening, said barrier permits air movement through the barrier but causes snow to accumulate thereon to occlude said passageway with snow and is permeable to water droplets.

2. The device of claim 1 wherein said barrier is supported within said passageway by a brace.

3. The device of claim 1 wherein said barrier is supported within said passageway by cross braces.

4. The device of claim 1 wherein said barrier is water resistant.

5. The device of claim 1 wherein said barrier is a webbed structure.

6. A roof vent for obstructing the entry of snow comprising:

a cover, support, and base;

said base adapted to form a passageway which connects a vented space to the environment;

a barrier located in an completely covering said passageway;

said barrier impermeable to snow to allow snow to occlude said passageway and permeable to water droplets.

* * * * *